United States Patent [19]

Haruhara

[11] 4,354,479

[45] Oct. 19, 1982

[54] INFRARED RAY GENERATOR

[75] Inventor: Tadao Haruhara, Suzaka, Japan

[73] Assignee: Orion Machinery Co., Ltd., Japan

[21] Appl. No.: 236,013

[22] Filed: Feb. 19, 1981

[30] Foreign Application Priority Data

Feb. 19, 1980 [JP] Japan ..... 55-20080[U]

[51] Int. Cl.[3] ..... F24C 3/04

[52] U.S. Cl. ..... 126/92 AC

[58] Field of Search ..... 431/347, 328, 329; 126/92 AC, 92 B, 92 R

[56] References Cited

U.S. PATENT DOCUMENTS

| | | | |
|---|---|---|---|
| 2,869,626 | 1/1959 | Sherman | 431/347 |
| 3,254,695 | 6/1966 | Brodlin | 431/328 |
| 3,561,422 | 2/1971 | Colin-Smith | 431/328 |
| 3,726,633 | 4/1973 | Vasilakis et al. | 431/329 |
| 3,762,390 | 10/1973 | Mendelson | 126/92 |
| 3,857,670 | 12/1974 | Karlovetz et al. | 431/329 |
| 4,140,100 | 2/1979 | Ishihara | 126/92 B |

FOREIGN PATENT DOCUMENTS

| | | |
|---|---|---|
| 557304 | 5/1957 | Belgium . |
| 1454304 | 2/1969 | Fed. Rep. of Germany . |
| 51-919422 | 11/1976 | Japan . |

*Primary Examiner*—Carroll B. Dority, Jr.

*Attorney, Agent, or Firm*—Toren, McGeady & Stanger

[57] ABSTRACT

An infrared ray generator includes a housing of heat resisting refractory material, the housing forming a first opening facing in a desired heating direction. A number of heat resistant fiber mesh screens cover the first opening and, together with the housing, form a combustion chamber. A burner extends through a second opening in the housing to direct a combustion flame into the combustion chamber so that the mesh screens are brought to red heat. Gaseous substances, which originate from the burner combustion flame, are then burned upon contacting the mesh screens, so that these substances do not pass to the outside air. The mesh screens also serve to suppress noise developed within the combustion chamber.

7 Claims, 7 Drawing Figures

INFRARED RAY GENERATOR

BACKGROUND OF THE INVENTION

The present invention relates to an infrared ray generator which operates with a supply of liquid or gaseous fuel.

Infrared ray generators, which are used for general indoor and outdoor heating and drying, such as heat sources for drying paint, require not only high combustion and heat radiation efficiencies, but also must generate infrared rays only a short time after combustion starts. It is also essential that operation noise, especially combustion noise, be kept as low as possible.

In order to fulfill these requirements, many kinds of infrared ray generators have been proposed and utilized. However, all of the conventional devices fail to fulfill all the above requirements, and sacrifice one or another of them in their design and use.

SUMMARY OF THE INVENTION

A primary object of the invention is to provide an infrared ray generator in which heat radiation efficiency is improved, without detracting from its fuel combustion efficiency.

Another object of the invention is to provide an infrared ray generator in which the time lapse from the start of combustion to generation of infrared rays is relatively short.

Still another object of the invention is to provide an infrared ray generator having low combustion noise.

In order to achieve these objects, the present invention includes a number of heat resistant inorganic fiber mesh screens arranged one on the other to cover a first opening in a chamber housing formed of a heat resisting refractory material. Together, the mesh screens and the housing form a combustion chamber. A burner extends through a second opening in the housing to direct a combustion flame into the interior of the combustion chamber, so that the mesh screens are brought to red heat. Combustion gases having flammable constituents contact the mesh screens and are burned, instead of passing to the air outside the combustion chamber. The mesh screens also operate to suppress combustion noise developed in the chamber.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there are illustrated and described preferred embodiments of the invention.

DETAILED DESCRIPTION OF THE INVENTION

Figure 1:
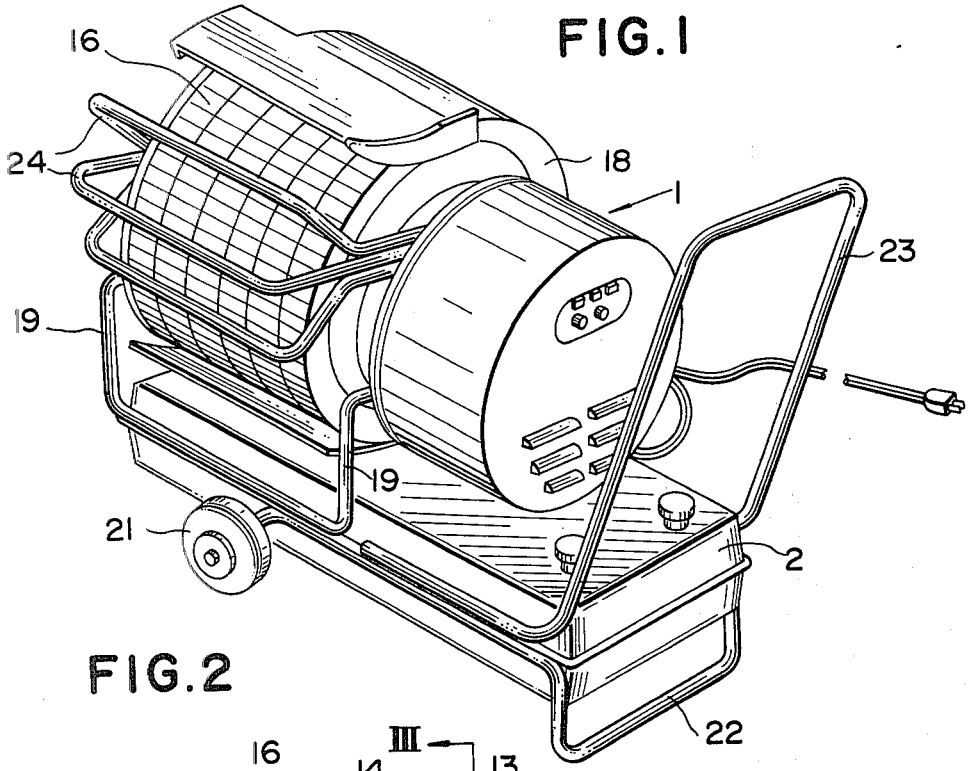
FIG. 1 is a perspective view of an infrared ray generator according to the present invention.
Figure 2:
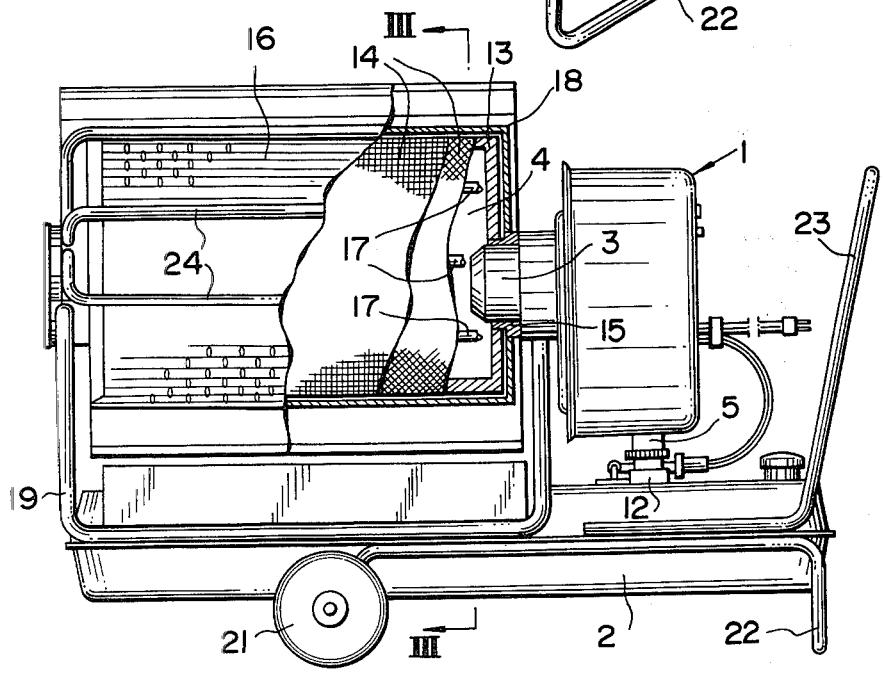
FIG. 2 is a view of the heat radiating side of the generator of FIG. 1, with parts broken away.

In FIGS. 1-4, a combustion device 1 according to the invention is supplied with liquid fuel from a fuel tank 2, and includes a burner 3 which projects into a combustion chamber 4 with its flame emitter end supported within the combustion chamber. A nozzle 7 of the burner 3 is connected to the fuel tank 2 through a filter 5 and a feed pump 6. An electrode 8 confronts the discharge end of nozzle 7 and is connected to a conventional igniter 9. A blower 10 sends combustion air into the combustion chamber 4 in the vicinity of the nozzle 7, and a temperature detector 11 stops the feed pump 6 when the temperature of the burner 3 goes beyond an allowable value. A turbulence detector 12 also operates to stop the feed pump 6 in the event the device 1 is jarred from its normal position by, for example, an earthquake or the like. The blower 10, the temperature detector 11 and the turbulence detector 12 are all conventional units.

Figure 3:
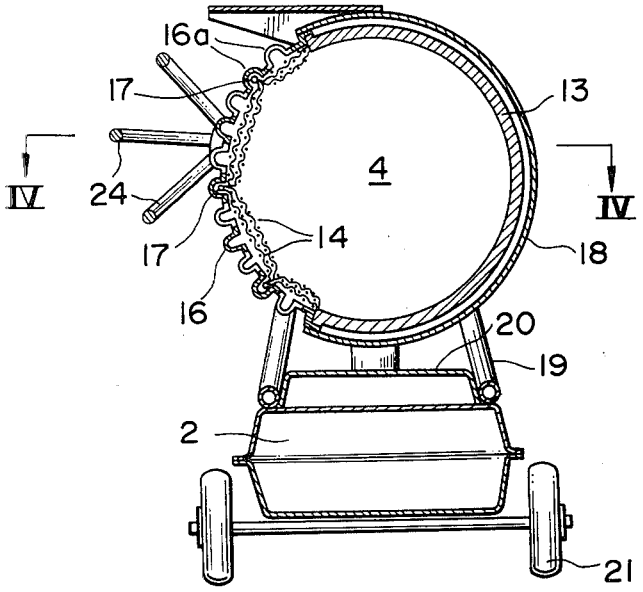
FIG. 3 is a cross-sectional view taken on line III—III of FIG. 2.
Figure 4:
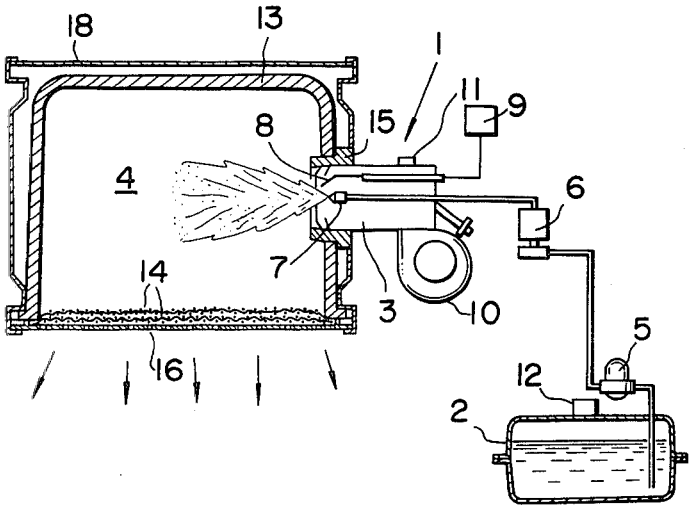
FIG. 4 is a partly cross-sectional view taken on line IV—IV of FIG. 3.

The combustion chamber 4 is formed in part by a combustion chamber housing 13, composed of a heat resisting refractory material, and is generally semi-cylindrically shaped. The chamber housing 13 includes a first end wall through which the burner 3 extends, and a second end wall which is opposite the first end wall. The combustion chamber 4 is also formed by a number of heat resistant inorganic fiber mesh screens 14 which extend from the axially extending edges of the chamber housing 13 to cover a chamber opening formed by these edges. The chamber opening faces in the direction in which heat from the chamber is radiated. A perforated metal plate 16 covers the surface of the mesh screens 14 facing in the heat radiating direction, so that the combination of the metal plate 16 and the chamber housing 13 form the generally cylindrically shaped combustion chamber 4 (FIG. 3). A mouthpiece or sleeve 15 extends through an opening in the first end wall of the chamber housing 13 and supports the burner 3. The sleeve 15 is also composed of a refractory material. The burner 3 is supported so that its nozzle 7 can direct a flame into the interior of the combustion chamber 4.

Figure 5:
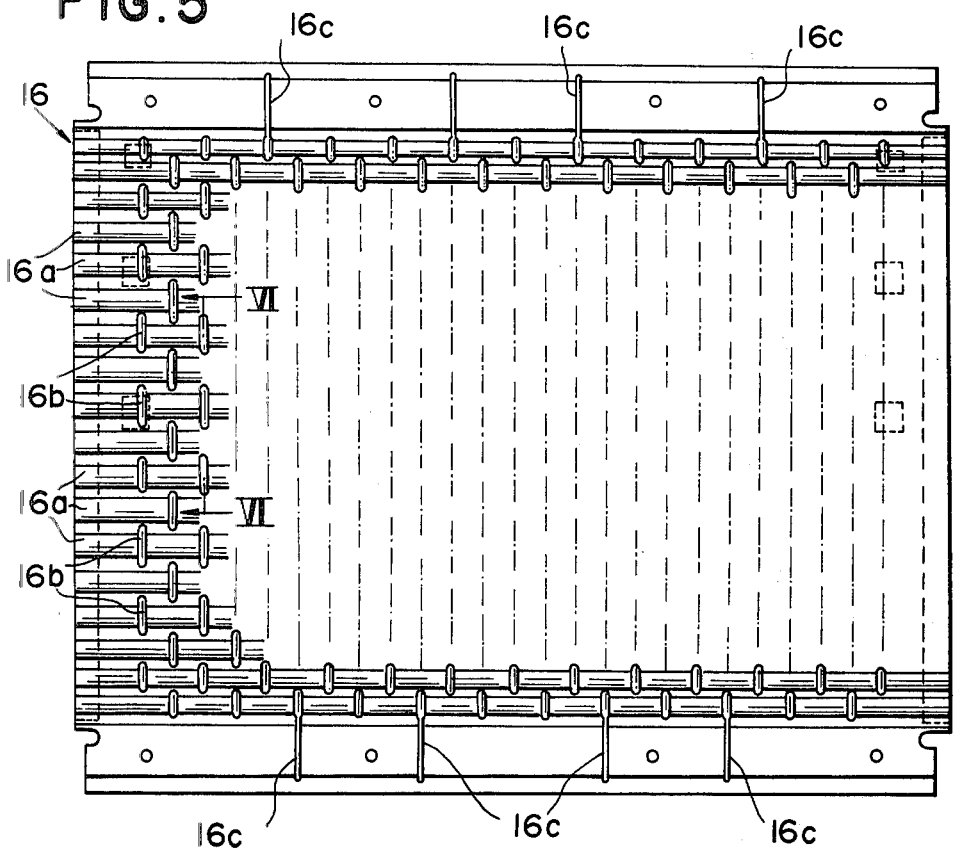
FIG. 5 is an enlarged view of a perforated metal plate on the side of the generator shown in FIG. 1.
Figure 6:
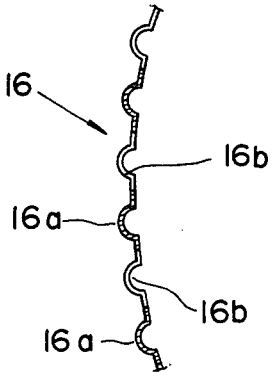
FIG. 6 is a cross-sectional view taken on line VI—VI of FIG. 5.

The chamber housing 13 is composed of, for example, ceramic fiber. The heat resistant inorganic fiber mesh screens 14 include, for example, rock wool which is knitted as a cloth or as a mesh, with an opening ratio of 5-25% with respect to the entire surface area of each screen. It is desirable that these materials have a small heat capacity. The perforated metal plate 16 is provided with a number of semi-circular protrusions **16*a* each extending in the axial direction and spaced angularly apart from one another, and projecting at given intervals in a radially outward direction relative to the combustion chamber axis. The perforated plate 16 also has a number of holes 16*b* extending through each of the protrusions 16*a* and arranged in circumferentially extending rows with the holes offset relative to one another in adjacent rows, as shown in FIG. 5. The ratio of the hole openings relative to the entire surface area of the perforated plate 16** is 7-15%.

The mesh screens 14 are pressed against and fixed to the inner surface of the perforated metal plate 16 by supporting rods 17 which extend in the direction of the combustion chamber axis and engage the mesh screens 14 at locations intermediate the axially extending edges of the chamber housing 13. Accordingly, the mesh screens 14 conform substantially with the inner surface of the perforated metal plate 16. A metallic casing 18 covers and supports the chamber housing 13, and a support frame 19 maintains the metallic casing 18 on top of the fuel tank 2 for swivelling movement about the axis of the combustion chamber.

A protective plate 20 (FIG. 3) covers the upper surface of the fuel tank 2. Wheels 21, a supporting leg 22 and a handle bar 23 are arranged together to allow the fuel tank 2 to be moved as a truck. Guard bars 24 extending parallel to one another in the axial direction of the combustion chamber extend over the front surface of the perforated metal plate 16, and circumferential slits 16*c* are provided at the upper and the lower edges of the metal plate 16 to prevent deformation of the plate from heat.

When the combustion device 1, described above, is operated, fuel is sprayed from the nozzle 7 of the burner 3, and air to be burned with the fuel is directed into the combustion chamber. When the igniter 9 is operated, the sprayed fuel is ignited and combustion begins.

When combustion flames are blown into the combustion chamber 4, the inner surface of the chamber housing 13 and the mesh screens 14 are both brought to red heat by the heat radiated from the flames.

Exhaust gas is discharged through the mesh screens 14 and the openings in the metal plate 16 into the outside air. Since the mesh screens 14 are brought to red heat, flammable substances contained in the exhaust gas which passes through the screens 14 are heated and burned. Specifically, a certain amount of flammable substances and oxygen remains in the exhaust gas which is to be discharged from the combustion chamber 4 into the outside air. Since the exhaust gas containing such flammable substances and the like is heated by contacting the mesh screens 14 which are at red heat, these substances are oxidized relatively easily.

Therefore, considering the present infrared ray generator as a whole, fuel is oxidized or burned first in the combustion chamber 4, and flammable substances from the fuel remaining in the exhaust gases are burned as they pass through the mesh screens 14. Accordingly, only exhaust gas free of flammable substances is discharged into the outside air.

Since the mesh screens 14 are arranged one over the other as a number of layers and, moreover, since the outermost screen 14 is covered by the perforated metal plate 16, the mesh screens 14 are seldom cooled by the outside air. Therefore, in the event two screens 14 are employed, than at least the inner mesh screen is heated and maintained at an extremely high temperature, allowing the interior of the combustion chamber 4 to remain at a higher temperature to burn the fuel efficiently and, at the same time, to burn almost completely the flammable substances in the exhaust gas. The fuel sprayed from the nozzle 7 is entirely converted into heat energy, thereby improving combustion efficiency. Further, as the temperature of the mesh screens 14 which cover the front or heat radiating side of the combustion chamber 4 increases, the quantity of infrared radiation from the mesh screens 14 also increases.

Since the mesh screens 14 have less heat capacity as compared with regular metal plates, and have excellent noise absorbing capabilities, the screens 14 are brought to red heat almost immediately after ignition thereby shortening the so-called "get-up" time or time lapse from ignition to infrared ray generation, and combustion noise which would otherwise pass outside the combustion chamber is significantly decreased.

Figure 7:
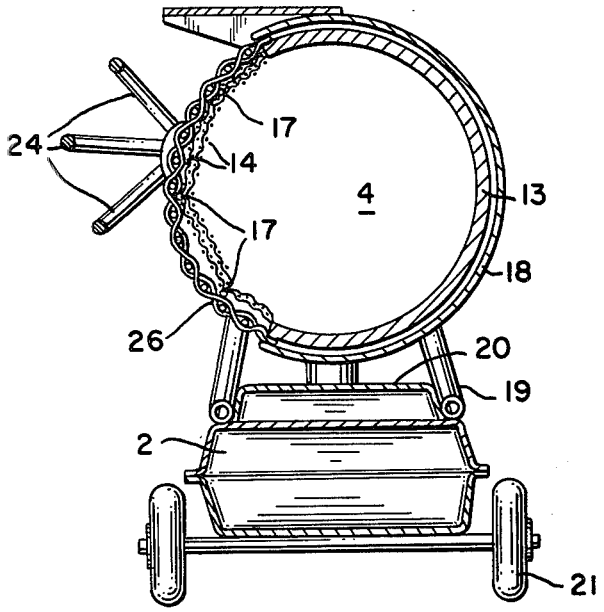
FIG. 7 is a view similar to FIG. 3, showing an example of a modification of the embodiment of FIGS. 1-6.

In the present embodiment, the cross-section of the combustion chamber 4 (FIG. 3) is arranged to be generally circular so that its surface area is as small as possible, thereby improving the temperature rising characteristic of the combustion chamber 4, and increasing the area of infrared ray radiation. Of course, the structure is not limited to the one shown in this embodiment. Further, although two mesh screens 14 are shown one over the other, three or more screens may be employed, or a single fiber mesh screen made by knitting a number of fiber meshes one on the other may be employed for easier mounting. Also, while the radially outer surfaces of the mesh screens 14 are shown as covered by the perforated metal plate 16, a conventional wire netting 26 may be used in place of the plate 16 as shown in FIG. 7, or such covering means for the mesh screens may be omitted.

As detailed above, the infrared ray generator of the present invention includes a combustion chamber which is formed in part by a chamber housing of a heat resisting refractory material, the housing having an opening along its side which opening faces in the desired heating direction. A number of heat resistant, inorganic fiber mesh screens cover this opening of the chamber housing, and a burner is arranged to direct a flame into the interior of the combustion chamber through a chamber opening other than the one which is covered by the mesh screens. This structure allows the temperature in the combustion chamber to be maintained higher than in other, conventional generators, and the exhaust gas to be oxidized or burned several times. It is, therefore, possible to completely burn the fuel supplied into the combustion chamber at least before discharging it into the outside air. By keeping the mesh screens heated by this complete combustion, combustion efficiency as well as infrared radiation efficiency are both improved. Moreover, since the mesh screens which cover the front opening of the chamber housing have a small heat capacity, and have excellent noise absorbing capabilities, the "get-up" time from ignition to infrared radiation is shortened, and combustion noise which would otherwise be heard outside of the combustion chamber is decreased.

While specific embodiments of the invention have been shown and described in detail to illustrate the application of the inventive principles, it will be understood that the invention may be embodied otherwise without departing from such principles.

What is claimed is:

1. An infrared ray generator comprising a housing of heat resisting refractory material, said housing having a first opening which faces in a desired heating direction, a number of heat resistant inorganic non-metallic mineral fiber mesh screens arranged one over the other to cover said first opening and to form a combustion chamber together with said housing, said mesh screens having a surface which faces in the heating direction, burner means extending through a second opening in said housing for directing a combustion flame into said combustion chamber so that said mesh screens are brought to red heat by the combustion flame and said mesh screens serve to burn flammable substances which originate from the combustion flame and contact said mesh screens, and screen support means fixed to said housing and in contact with said surface of said mesh screens which surface faces in the heating direction for supporting said mesh screens.

2. An infrared ray generator as claimed in claim 1, wherein said screen support means comprises a perforated metal plate.

3. An infrared ray generator as claimed in claim 1, wherein said screen support means comprises a wire netting.

4. An infrared ray generator comprising a housing of heat resisting refractory material, said housing having a first opening which faces in a desired heating direction, a number of heat resistant inorganic fiber mesh screens arranged one over the other to cover said first opening and to form a combustion chamber together with said housing, said mesh screens having a surface which faces in the heating direction, burner means extending through a second opening in said housing for directing a combustion flame into said combustion chamber so that said mesh screens are brought to red heat by the combustion flame and said mesh screens serve to burn flammable substances which originate from the combustion flame and contact said mesh screens, and screen support means including a perforated metal plate fixed to said housing and in contact with said surface of said mesh screens which surface faces in the heating direction for supporting said mesh screens, wherein said housing and said metal plate are each generally semi-cylindrically shaped to form said combustion chamber generally in the shape of a cylinder, and said metal plate includes a number of semi-circular protrusions each extending in the axial direction of said combustion chamber and projecting at spaced apart angular intervals in a radially outward direction relative to the axis of said combustion chamber.

5. An infrared ray generator as claimed in claim 4, wherein said metal plate has a number of holes through each of said protrusions, said holes extending over between 7–15% of the entire surface area of said metal plate.

6. An infrared ray generator as claimed in claim 1, wherein each of said mesh screens has an opening ratio of between 5–25% of its entire surface area.

7. An infrared ray generator as claimed in claim 1, wherein said mesh screens comprise a material which serves to suppress combustion noise developed within said combustion chamber.

* * * * *